United States Patent [19]

Kiwior et al.

[11] 4,057,190

[45] Nov. 8, 1977

[54] FUEL BREAK-UP DISC FOR INJECTION VALVE

[75] Inventors: Alexander Michael Kiwior, Warren; James Daniel Bode, Royal Oak, both of Mich.

[73] Assignee: Bendix Corporation, Southfield, Mich.

[21] Appl. No.: 696,999

[22] Filed: June 17, 1976

[51] Int. Cl.[2] ..... B05B 1/30

[52] U.S. Cl. ..... 239/558; 239/533.12; 239/562; 239/568; 239/585

[58] Field of Search ..... 239/533.3–533.12, 239/562, 558, 559, 568, 585

[56] References Cited

U.S. PATENT DOCUMENTS

| | | | |
|---|---|---|---|
| 959,618 | 3/1910 | Schmidt | 251/76 |
| 1,081,228 | 12/1913 | Fuchs | 123/30 A |
| 1,162,173 | 11/1915 | Junkers | 239/562 X |
| 1,301,719 | 4/1919 | Lloyd | 239/584 |
| 1,333,681 | 3/1920 | Riley | 251/130 |
| 1,360,558 | 11/1920 | Mattsson | 29/90 R |
| 1,363,470 | 12/1920 | Knudsen | 239/533.8 X |
| 1,390,022 | 9/1921 | Coakley | 113/120 R |
| 1,777,051 | 9/1930 | Scott | 239/533.6 |
| 1,944,113 | 1/1934 | Shenton | 137/139 |
| 2,284,234 | 5/1942 | Seegers et al. | 285/157 |
| 2,292,409 | 8/1942 | Steward | 123/32 |
| 2,296,132 | 9/1942 | Wiseley | 137/139 |
| 2,310,773 | 2/1943 | Fuscaldo | 123/119 |
| 2,382,151 | 8/1945 | Harpder, Jr. | 239/558 |
| 2,511,992 | 6/1950 | Quick | 123/32 |
| 2,557,514 | 6/1951 | Ray | 251/20 |
| 2,578,795 | 12/1951 | Gardiner et al. | 137/53 |
| 2,626,186 | 1/1953 | Nakken | 239/533.3 |
| 2,700,963 | 2/1955 | Crawford | 123/33 |
| 2,771,321 | 11/1956 | Alric | 239/574X |
| 2,927,737 | 3/1960 | Zeuch et al. | 239/533.3 |
| 2,951,647 | 9/1960 | Dreisin | 239/453 |
| 2,985,378 | 5/1961 | Falberg | 239/96 |
| 3,017,873 | 1/1962 | Dietrich | 123/119 |
| 3,159,350 | 12/1964 | Mangold | 239/533 |
| 3,255,974 | 6/1966 | Roosa | 239/533 |
| 3,400,440 | 9/1968 | Carlson | 29/157.1 |
| 3,400,440 | 9/1968 | Carlson | 239/533 X |
| 3,490,701 | 1/1970 | Malec | 239/584 |
| 3,542,293 | 11/1970 | Bishop et al. | 239/95 |
| 3,587,269 | 6/1971 | Seccombe | 72/75 |
| 3,598,314 | 8/1971 | Bailey | 239/96 |
| 3,613,998 | 10/1971 | Krauss | 239/543 |
| 3,641,802 | 2/1972 | Segro | 72/377 |
| 3,661,183 | 5/1972 | Komaroff | 137/625.65 |
| 3,680,794 | 8/1972 | Romann et al. | 239/585 |
| 3,736,640 | 6/1973 | Freiheit | 29/151.1 R |
| 3,738,387 | 6/1973 | Ingram | 137/625.65 |
| 3,738,578 | 6/1973 | Farrell | 239/585 |
| 3,782,639 | 1/1974 | Boltz et al. | 239/405 |
| 3,836,080 | 9/1974 | Butterfield et al. | 239/96 |
| 3,876,152 | 4/1975 | Roosa | 239/533 |
| 3,876,153 | 4/1975 | Roosa | 239/533 |
| 3,908,911 | 9/1975 | Hofmann et al. | 239/533 |
| 3,913,537 | 10/1975 | Ziesche et al. | 123/32 AE |
| 3,941,109 | 3/1976 | Schmid | 123/139 AW |
| 3,943,892 | 3/1976 | Brinkman | 123/32 EA |
| 3,943,904 | 3/1976 | Byrne | 123/139 AW |
| 3,961,644 | 6/1976 | Eckert | 137/625.65 |
| 3,967,597 | 7/1976 | Schlagmuller | 123/32 JV |

FOREIGN PATENT DOCUMENTS

| | | | |
|---|---|---|---|
| 733,476 | 10/1932 | France | 123/139 AW |
| 754,167 | 8/1944 | Germany | 123/32 AE |
| 624,152 | 10/1936 | Netherlands | 239/559 |
| 891,037 | 3/1962 | United Kingdom | 239/533.4 |
| 14,662 of | 1913 | United Kingdom | 239/562 |
| 708,886 | 5/1954 | United Kingdom | 123/139 AW |

OTHER PUBLICATIONS

Rayleigh "On The Capillary Phenomena of Jets" Proceedings of the Royal Society, XXIX, pp. 71–97, 1879, Rayleigh, Scientific Papers, vol. 1, Dover Publications 1964.

*Primary Examiner*—John J. Love
*Attorney, Agent, or Firm*—Gerald K. Flagg

[57] ABSTRACT

A low-cost precise-metering uniform-fuel-breakup fuel injection valve comprises narrow arcuate slots etched through a thin spray disc located downstream of a metering orifice and comprises a plurality of narrow slots of length and width sufficient to break up the fuel first into thin sheets and then into small droplets of uniform diameter.

3 Claims, 10 Drawing Figures

ELECTRONIC COMPUTING UNIT
RPM-40
TEMP-42
MAP-44

FUEL BREAK-UP DISC FOR INJECTION VALVE

CROSS REFERENCE TO RELATED CASES

This application is related to commonly-assigned U.S. application Ser. No. 697,173 by Kiwior filed concurrently herewith and entitled "Electromagnetically Operated Fuel Injection Valve," this application issued as U.S. Pat. No. 4,030,688 on June 21, 1977.

BACKGROUND OF INVENTION

1. Field of Invention

This invention relates to fuel break-up for fuel injection valves and particularly to fuel break-up means comprising a thin disc having a plurality of narrow slots therethrough of a length and width sufficient to break the fuel up first into thin sheets and then into uniformally small droplets.

2. Description of Prior Art

Conventional fuel injection valves, such as of the type disclosed in the patent to Kirsch, U.S. Pat. No. 3,828,247, comprise one of the most expensive components of fuel injection systems in current mass production for passenger vehicles. Such conventional injectors incur such comparatively high costs because most of the structural elements effecting fuel breakup, fuel spray angle, fuel metering and flow on/off valving are made to extremely close tolerances. Meeting these tolerances requires specialized lapping by a tool that cannot be used again for final lapping, and the resulting parts are custom rather than randomly mated. Even then such conventional fuel injection valves do not normally breakup the fuel into uniformly small particles and thereby limit the attainment of both maximum fuel economy and minimum formation of undesirable emissions. Moreover, comprising extremely-narrow and closely-toleranced fuel metering and breakup paths, such conventional valves are susceptible to the deleterious effects of contamination passing the inlet filters of the injectors or back flowing from engine inlet passages to the injector outlet sections. It is therefore desirable to reduce the cost of fuel injection valves by avoiding the conventional lapping and redressing, custom hand mating, and generally tight tolerancing all over.

A primary factor imposing harsh tolerancing requirements on such conventional fuel injection valves is the use of different elements of just one part, a reciprocating pintle-type needle-valve member, to perform the breakup, metering, and valving functions. Each such different element must be closely concentric not only with the other elements of the same part but also with each of the surrounding structures cooperating with such elements.

The present invention recognizes that at least the close concentricity tolerances could be substantially relaxed and in turn other gross cost savings obtained by effecting the on/off valving function by a structure substantially separate from that effecting the fuel breakup function and the metering function. More specifically, recognizing that a circular seating edge need not be closely concentric with the metering orifice, the invention allows the use of no less than three cost saving processes: 1) the conventional loose-concentricity low-cost "ballizing" process of forcing a final diameter precision ball through an initially undersized aperture to repeatably provide highly finished uniform orifices; 2) the conventional loose-concentricity low-cost "coining" process of forcing a precision ball against a softer conical surface to repeatably provide a circular non-leaking seating edge; and 3) the conventional loose-tolerance ball valve head and oversized ball seat technique to repeatably effect the on/off valving. Thus, even though the patents to Mattson, U.S. Pat. No. 1,360,558 and Seccombe, U.S. Pat. No. 3,587,269 suggests the use of ballizing, even though the patent to Carlson, U.S. Pat. No. 3,400,440 suggests a fuel injection valve having a ball seat coined by a slightly larger ball, and even though the patent to Malec, U.S. Pat. No. 3,490,701 suggests the use of a stem-mounted ball valve, such prior art not withstanding fuel injection valves are not known to have heretofore used any combination of a ballized metering orifice, with a coined valve seat, or a stem-mounted ball valve head, perhaps because of the severe concentricity requirements previously thought to be essential.

As indicated above, a primary function of a fuel injection valve is to break up a metered quantity of fuel into combustible particles. Generally, the smaller the fuel droplets, the more readily they vaporize for combustion and the more completely they burn. Moreover, the more complete and effecient the combustion, the better the brake specific fuel consumption or mileage and the less the generation and emission of undesirable exhaust emissions. Conventional injectors of the type disclosed in the above-mentioned Kirsch patent develop a spray by forcing fluid between a closely toleranced needle and its single surrounding closely-toleranced annular orifice, and the resulting drop sizes comprising such spray are of varied sizes and distributions depending on the actual dimensions of the annular orifice. Moreover, while a fuel injector using a plurality of circular apertures through a thick plate is disclosed in the patent to Harper Jr. 2,382,151, such circular apertures generate a generally pear-shaped solid cloud of fuel particles rather than control the size or variation thereof of the particles. Moreover, circular holes of the requisite smallness are difficult to fabricate repeatably even by etching. The analysis by Rayleigh in his "On the Capillary Phenomena of Jets" (Proceeedings of the Royal Society, XXIX pp 71–97, 1879, Rayleigh, Scientific Papers, Vol. 1, Dover Publications, 1964) is therefore also of interest to the present invention. There Raleigh noted that non-circular orifices through thin plates produced flat broad thin liquid sheets of fluid. More recent analyses, such as by Keller and Koldner in the Journal of Applied Physics Vol 25 pp 918–21 (1954), show that thin sheets produce small droplets. However, it was not appreciated until recognized by the present invention that non circular slots of the requisite small width could be etched more precisely than circular apertures with the result that the thin-plate-non-circular-slot thin-liquid-sheet small-droplet theory is not known to have heretofore been applied to fuel injection valves. It is therefore desirable to improve fuel economy while at the same time reducing undesirable emissions by breaking up the metered fuel first into thin sheets and then into uniformly small fuel droplets. Conventional injection valves of the type noted above do little if anything to shape the envelope of the spray emitted from the annular orifice. This results in a wide angle spray that wets the sides of the intake passages so as to enter the combustion chamber in an unevenly rich and lean distribution. The present invention recognizes that such wetting and uneven distribution may be reduced by providing a spray-envelope-shaping nozzle as a part of the injector immediately downstream of the fuel breakup disc.

The pressure drop across the fuel breakup means of a conventional fuel injection valve is another factor requiring very tight tolerancing of not only the metering orifice but also the breakup apertures. Since the precision of the quantity of fuel injected on each injection pulse is dependent on having a known flow rate while the injection valve is open and since a known flow requires having a known pressure drop across a known flow area, the area of any part of the flow path across which there is any significant pressure drop must be known and therefore closely controlled. The present invention therefore further recognizes that the size tolerances on the fuel breakup means could be relaxed by effecting the breakup function by a structure substantially separate from that effecting the metering function and by then designing the fuel breakup means so as to have a minimum pressure drop thereacross. In other words, the present invention recognizes the desirability of providing fuel breakup means having a sufficient flow area and minimal axial thickness so as to not generate any pressure drop significant to fuel flow accuracy. In this way the tolerances on the non-circular breakup apertures could be determined, not so as to effect a requisite pressure drop by means of a precisely known flow area therethrough, but rather to effect the requisite drop size, the tolerances on the breakup apertures being looser than those on a metering orifice. Moreover, the tolerances on the breakup apertures could then be held by the low cost etching through thin plates.

Conventional fuel injection valves introduce an undesirable, and often vehicle disabling, "hot start" problem upon restarting or attempting to restart an overly hot engine before it has had sufficient time to cool down. More specifically, during the comparatively short time between shutting down an engine in an overly hot environment and attempting to restart the engine, all the components under the hood experience a "hot soak" as the overly hot engine conducts, convects, and radiates heat to the auxiliary components. In the case of the fuel injection valves, the temperatures thereof are so elevated compared to the temperatures associated with normal operation that the fuel is substantially vaporized before reaching the valving and metering elements. To the extent that the fuel is vaporized prior to being metered, less liquid fuel is expelled from the injector during a given injection interval than is expelled under normal operating conditions when the fuel is substantially liquid. Consequently, to the extent that more vaporized than liquid fuel is injected into the inlet passages of the engine, a substantially leaner than desired mixture is injected. Such leaner mixture is often insufficient to permit proper ignition, preventing ignition under the worst cases and otherwise effecting stumbling to rough ignition under less severe cases as the mixtures richen up to the desired air-fuel ratio. The duration of such undesirable lean mixture performance varies primarily with the difference between the hot soak and normal operating temperature and the rate at which the hot soak thermal energy is removed from the injector.

To avoid such "hot restart" problems, it is desirable to reduce the problem-causing conduction, convection, and radiation of heat from the engine to the injectors and then to eliminate whatever hot soak energy is transfered thereto as fast as possible upon hot restarting. More specifically, it is desirable to minimize the initial conduction of hot soak energy to the injectors by minimizing the surface contact area between the engine and the injectors and by minimizing convection and radiation by increasing the air space between the exterior of the engine and the exterior of the injector. Furthermore, to reduce the time required to remove whatever heat has been transfered to the injectors, it is desirable to reduce the cross-sectional area of the injectors so as to increase the air space between the engine and injector, to reduce the stored hot soak energy that must subsequently be removed, and to otherwise maximize the rate that heat is transferred from the body of the injectors.

In solving this problem, the present invention recognizes that smoothly-flowing normally-cooler fuel has a higher coefficient of heat transfer than turbulently flowing fuel and, not being turbulent, can be metered more precisely. In this regard, the present invention recognizes that it is desirable to induce a substantially smooth flow and to do so by a substantially straight and unimpeded central fuel flow immediately upstream of the valve and orifice rather than the prior art side-ported and peripherally-channelled fuel flow of the types produced by the valves disclosed in the above mentioned patents.

A further primary function effected by a fuel injection valve is to repeatably and rapidly actuate the valve by the electromagnetic interaction between the flux produced by a fixed coil acting on a movable plunger or armature connected to the valve head. Conventionally, the actuator is electromagnetically opened to a position determined by the abutment of a shoulder protruding from the actuator against suitable abutment on the valve body such abutment normally being in the form of a "C" washer. Upon de-energization of the coil the actuator is spring closed to a closed position determined by seating of the valve head on the valve seat. To effect as rapid a response as possible with the establishment of a threshold level of magnetomotive force by the coil, the actuator is made as light as possible and the magnetic lock up between the fixed and movable elements is prevented by maintaining minimum magnetic air gaps for the magnetic flux. In addition to permitting faster opening response, a light actuator permits the use of a weaker closing spring to effect softer closing and thereby also reducing the pounding wear between the valve head and valve seat. The outer surface of a conventional actuator and the mating inner surface of a conventional actuator housing are therefore heat treated and closely toleranced as to diameter and squareness so as to provide a durable sliding metal-to-metal contact. Such close tolerancing is required: 1) to enable the actuator to precisely pilot and center the valve head on the valve seat; 2) to precisely pilot and center the pintle needle in the metering orifice; and 3) to maintain the minimum magnetic air gaps axially between the rear end of the armature and the front of the fuel inlet tube and also radially between the outer diameter of the armature and the inner diameter of the mating valve body. It is desirable to avoid heat treatment and relax these tolerances especially since they must otherwise be maintained on substantially blind and very small actuator housing bores.

The present invention recognizes that an actuator which is tubular in form enhances such lightness in addition to also inducing a smoothing better-cooling-and-metering effect on the central flow therethrough. Moreover, the present invention further recognizes that, rather than providing a sliding metal-to-metal contact between the actuator and its housing, it is more desirable to do the opposite by providing an ample positive clearance therebetween to allow the resulting surrounding pressurized fluid fuel to sufficiently center the actuator to effect the necessary seating and to maintain the minimum air gaps. Also, lower actuation energy is required when the actuator slides on a fluid rather than metal surface, also permitting a weaker closing spring resulting in lower closing impact and longer actuator life. The present invention further recognizes that a positive clearance between the actuator and its housing also enables the actuator to provide some of the flexing action otherwise required of the stem to properly seat the stem-mounted ball valve head on the valve seat. More specifically, the length of the actuator telescoping the stem and free to move in the positive clearance acts as extension of the stem and thereby reduces the life limiting flex stresses that would otherwise be imposed thereon.

A further cost imposing feature of conventional fuel injection valves heretofore used with commercial passenger vehicle fuel injection systems is that the electromagnetically responsive armature is mounted on a non-magnetic actuator. Not only is the non-magnetic material more costly per pound by half again as much as the magnetic material, but the separate armature and actuator parts require close tolerance machining of the requisite mating concentric bores in the armature and receiving surfaces on the actuator followed by the close tolerance axial positioning of the armature on the actuator. The main reason requiring such separate materials apparently was the previous belief that, unless the actuator was of non-magnetic material, the motion limiting stop shoulder thereof would effect a magnetic lock-up with the magnetic return path of the valve body and would thereby unacceptably slow the opening and closing times of the injector.

The present invention recognizes that any magnetic lock-up between the actuator shoulder and valve body is second order compared to that possible between cylindrical outer surface of the armature and valve body because the latter provides not only the shorter flux return path inherently effected by magnetic flux but also provides more mating gap surface. The present further recognizes that, rather than suffering the cost and other penalties of providing an armature and actuator of different materials, it is feasible and more desirable to do the opposite by making not just the armature and actuator but also the actuator housing out of the same material. By doing so avoids the differential thermal expansion rates heretofore resulting from different coefficients of expansion. Also avoided is the growth of crystals in the gaps normally resulting from the galvanic corrosion reaction conventionally occuring between the dissimilar materials of the actuator and its housing, such similar material thereby further reducing the friction therebetween while increasing valve life by avoiding catastrophic galvanic-growth-induced seizure of the actuator to its housing.

Yet another problem heretofore experienced with electromagnetically actuated fuel injection valves is that the welded connections between the end of coil wire and the output terminal of the injector often break when the output terminals are wiggled on the assembly, connector molding, testing, shipping, or subsequent engine mounting and connection of the injector. Conventional fuel injection valves of the type noted above attempt to avoid these problems by the use of L-shaped terminals that enter the injector axially and then, make an "L" turn in opposing circumferential directions so that the inside of coil bobbin and/or inlet connector flange prevents the terminals from being moved axially. Such terminals of course are not stamped out from lower cost straight ribbon stock of terminal width. It is therefore desirable to provide a straight narrow terminal that can be securely anchored within the bobbin.

OBJECTS OF INVENTION

It is therefore a primary object to provide a new and useful fuel break up means having a cost substantially less than that of conventional fuel break up means mass produced with for use with passenger vehicle fuel injection systems.

It is another primary object of the present invention to provide a new fuel break up means of the foregoing type that may be fabricated by low cost etching or stamping processes.

It is another primary object of the present invention to provide a new and improved fuel break up means for enhancing fuel economy while at the same time reducing the generation of undesirable emission constitutents by breaking up fuel first into thin sheets and then into uniformly small droplets.

It is another object of the present invention to provide duel break up means of the foregoing type comprising a thin fue breakup disc having an aperture area at least half again as large as that of the metering orifice of the fuel injection valve in which it is used so that, by dropping substantially all of the available flow pressure across the metering orifice the tolerances on the breakup apertures are relaxed to those required to obtain uniformally small fuel droplets.

It is a further object of the present invention to provide a new and improved fuel break up disc of the foregoing type wherein the fuel is broken into uniformally small particles by a plurality of narrow slots the widths of which are about 0.10 mm, the lengths of which are at least twice the widths, and the separations between which are sufficient to avoid congealing sheets of fuel from adjacent slots.

SUMMARY OF INVENTION

The fuel injection valve provided in accordance with the present invention comprises a thin fuel breakup disc formed by etching thin arcuate slots of about 0.1 mm in radial width therethrough. The disc is located intermediate a spray envelope forming nozzle and the outlet end of a divergent conical surface leading from a metering orifice. The metering orifice is formed by forcing a ball of final diameter through an initially undersized aperture. Upstream of the inlet end of the metering orifice is a circular seating edge formed by coining a ball onto a conical surface converging towards the metering orifice. The diameter of the coining ball is slightly larger than that of the valve head forming a substantially non-leaking seal with the circular seating edge of the ball valve seat when biased thereagainst by a valve closing spring and fuel pressure. The metering orifice and valve seat are either integral with or engaged by a tubular actuator housing which in turn is sealably engaged in an actuator housing cavity of a tubular valve body (also comprising a coil and inlet assembly) in which a coil and inlet assembly is sealably engaged.

Positioned for sliding reciprocating motion within the actuator housing is a tubular actuator comprising a tubular armature and a ball valve head mounted at the free end of a flexible stem the fixed end of which is secured at the end of a central passage in the armature. The tubular armature is received in a counter-bore in one end of the actuator housing and the actuator reciprocates in the actuator housing between a closed position defined when the ball valve head seats on the ball valve seat and an open position defined when the radial shoulder on the armature abuts a "C" washer positioned against an annular hub of the valve body. The cylindrical periphery of the armature comprises one or more pair of slots cut 180° apart and of sufficient length and depth to provide a two axial passage each communicating the central passage of the armature and the inlet passages of the fuel inlet assembly. A helical valve closing spring is positioned between the rear of the armature and the front of the fuel inlet assembly to provide the fuel pressure an axially closing bias to the actuator. The inlet assembly, the actuator, and the actuator housing may be of the same magnetic steel.

The coil and inlet assembly of the injector comprises a coil bobbin having terminal insulating posts extending axially through a radial flange on the inlet connector. Each post has an axial terminal slot therein to receive the then section of a terminal. The insulating post comprises a welding and dimple aperture directly over the terminal slot and ending in a radial dimple locking wall thereover. The terminal comprises a dimple across substantially the entire narrow width thereof, the dimple cooperating with the dimple locking wall after the terminal is inserted into the terminal slot to retain the terminal therein.

FIGURES

Figures 1, 2:
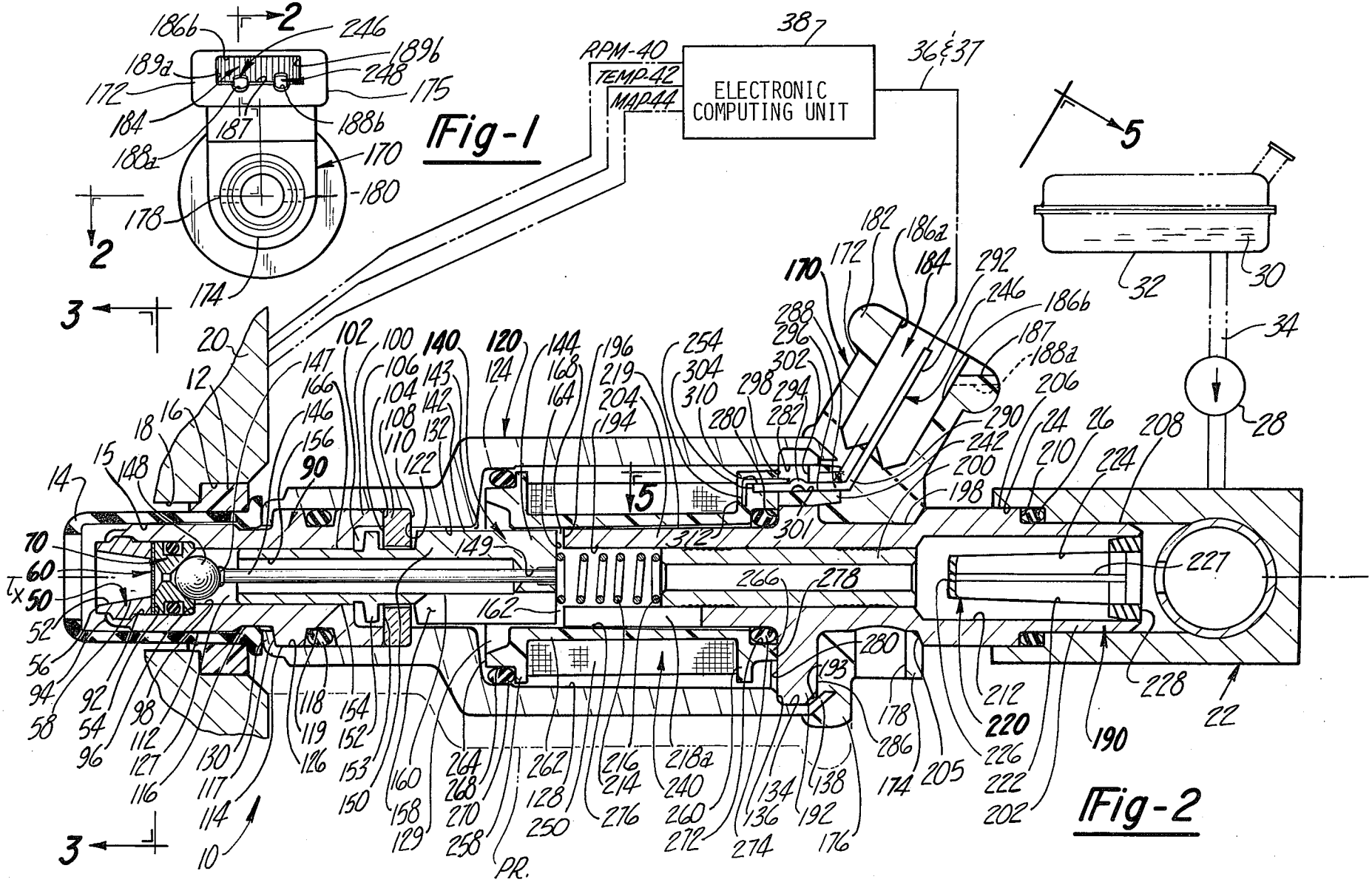
FIG. 1 is an end view of a preferred embodiment of a fuel injection valve constructed in accordance with the present invention.
FIG. 2 is a view of the fuel injection valve of FIG. 1 taken along partially rotated view 2—2 thereof.
Figure 3:
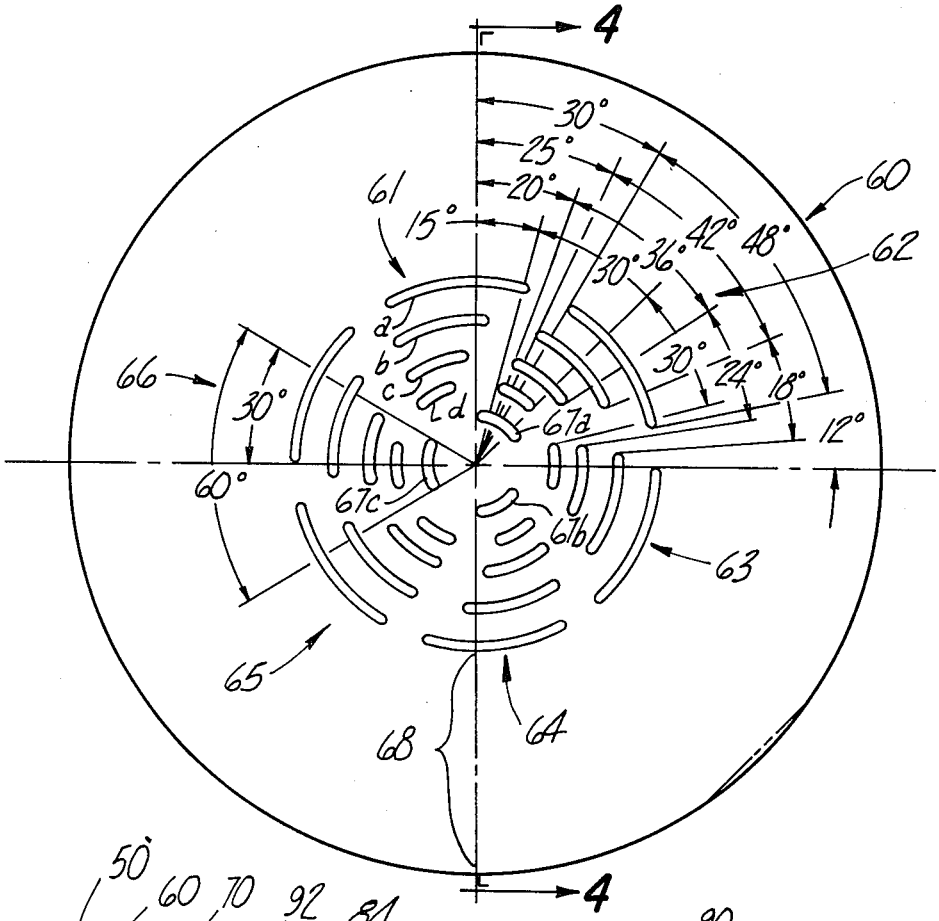
FIG. 3 is a view of the fuel injector valve of FIG. 2 taken along view 3—3 thereof showing a fuel breakup disc etched with thin-slot apertures therethrough in accordance with a preferred configuration of the present invention.
Figure 4:
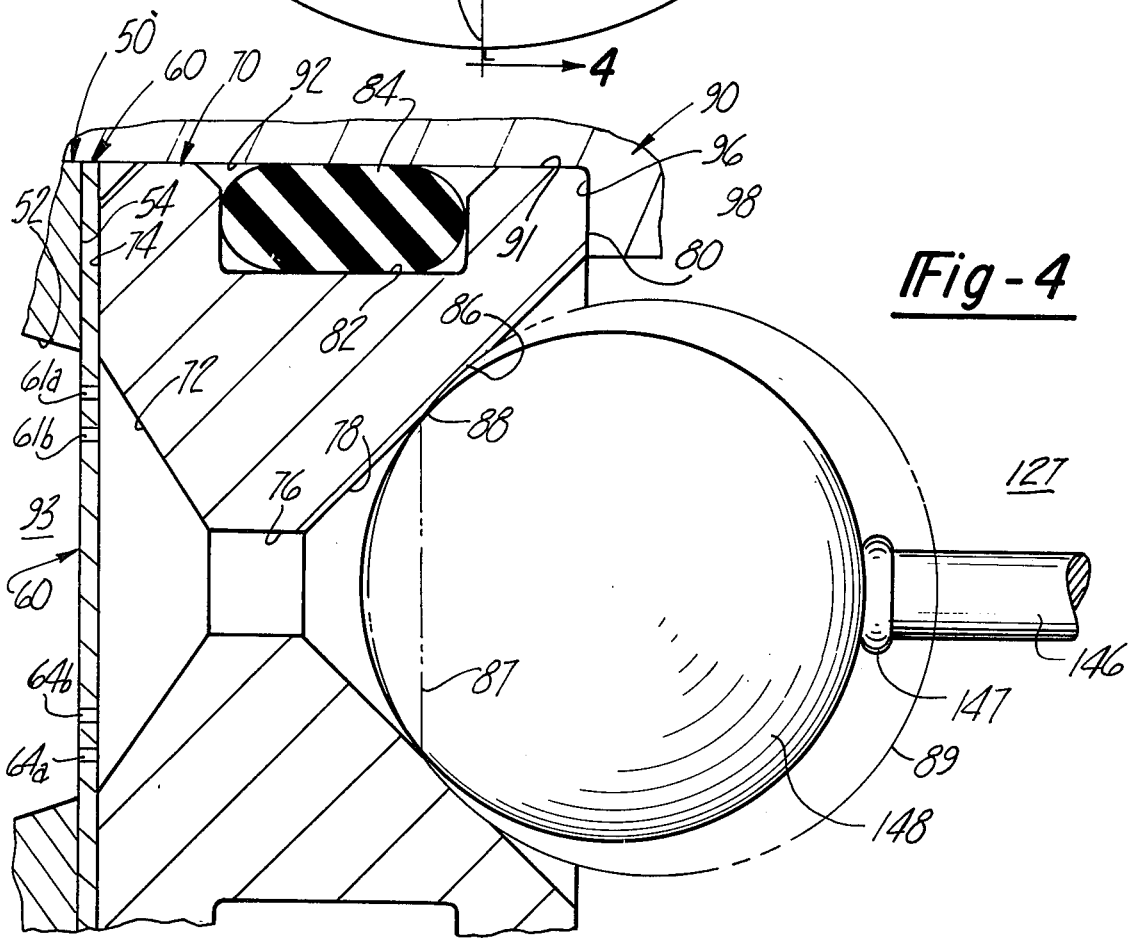
Figure 6C:
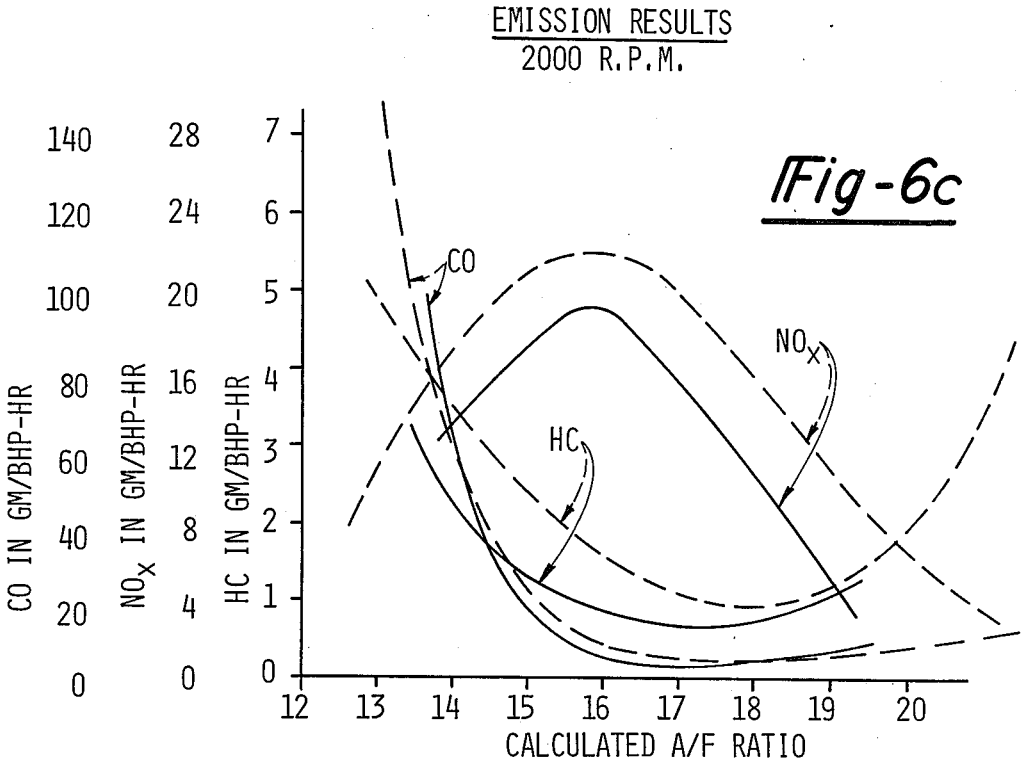
Figure 5:
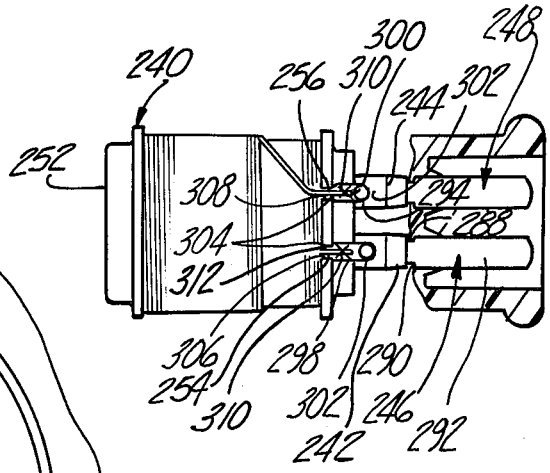
Figure 3A:
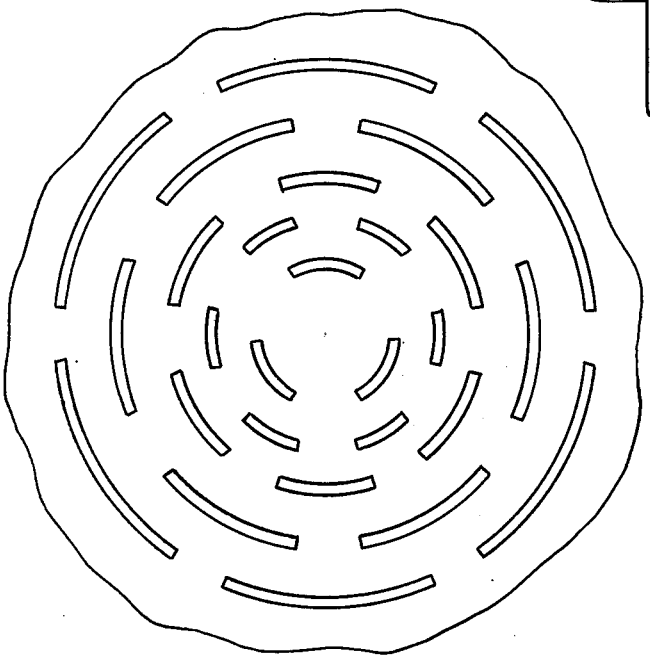
Figure 6A:
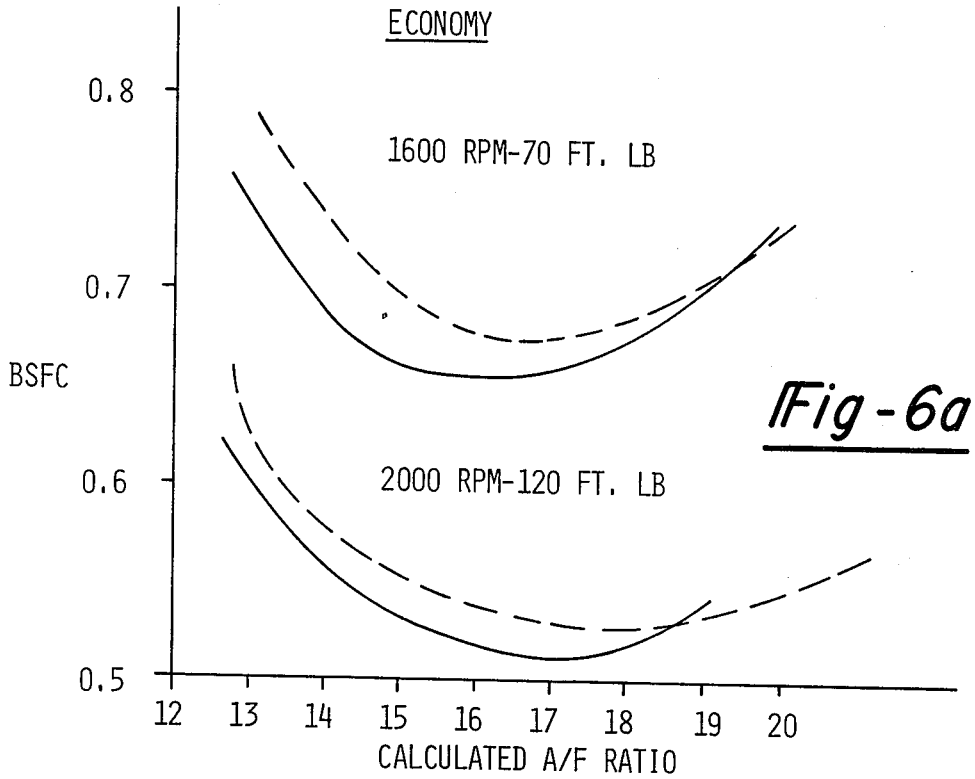
Figure 6B:
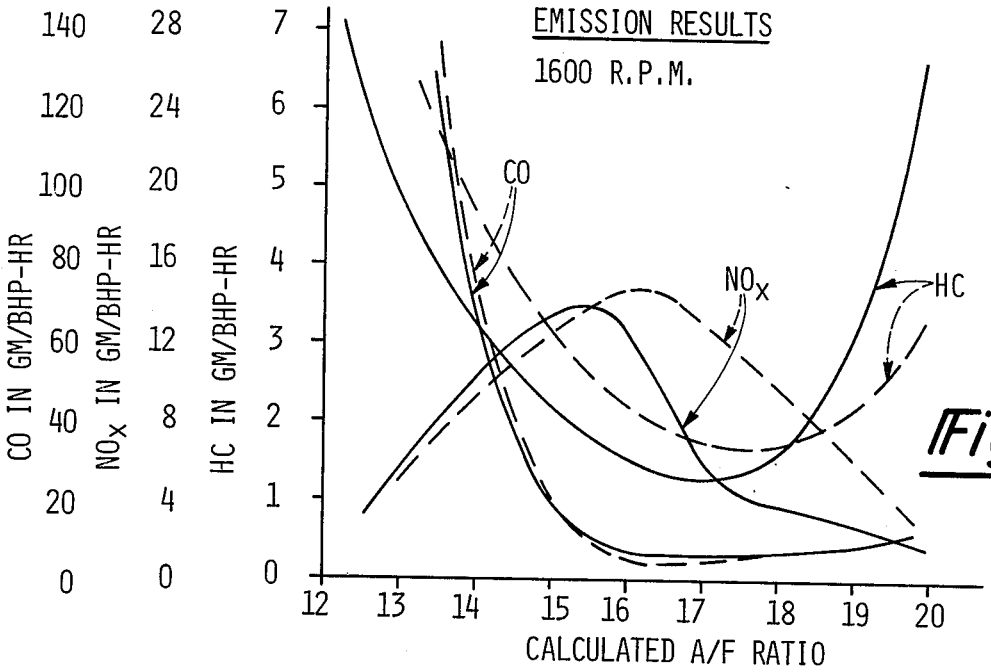

FIG. 3*a* is a plan view of an alternative configuration of slots etched through a thin breakup disc;

FIG. 4 is an enlarged and exaggerated view of the valve seat and orifice portion of the fuel injection valve of FIG. 1;

FIG. 5 is a plan view of a fuel injection valve of FIG. 2 taken along view 5—5 thereof so as to show the combination of an electrical terminal with an insulator post; and FIG. 6*a*, 6*b* and 6*c* shows and compares the brake specific fuel consumption (BSFC) and emission results at different engine loads and speeds for different air fuel ratios of the fuel injection valve of the present invention (solid lines) and of the prior art (dashed lines).

Figure 7:
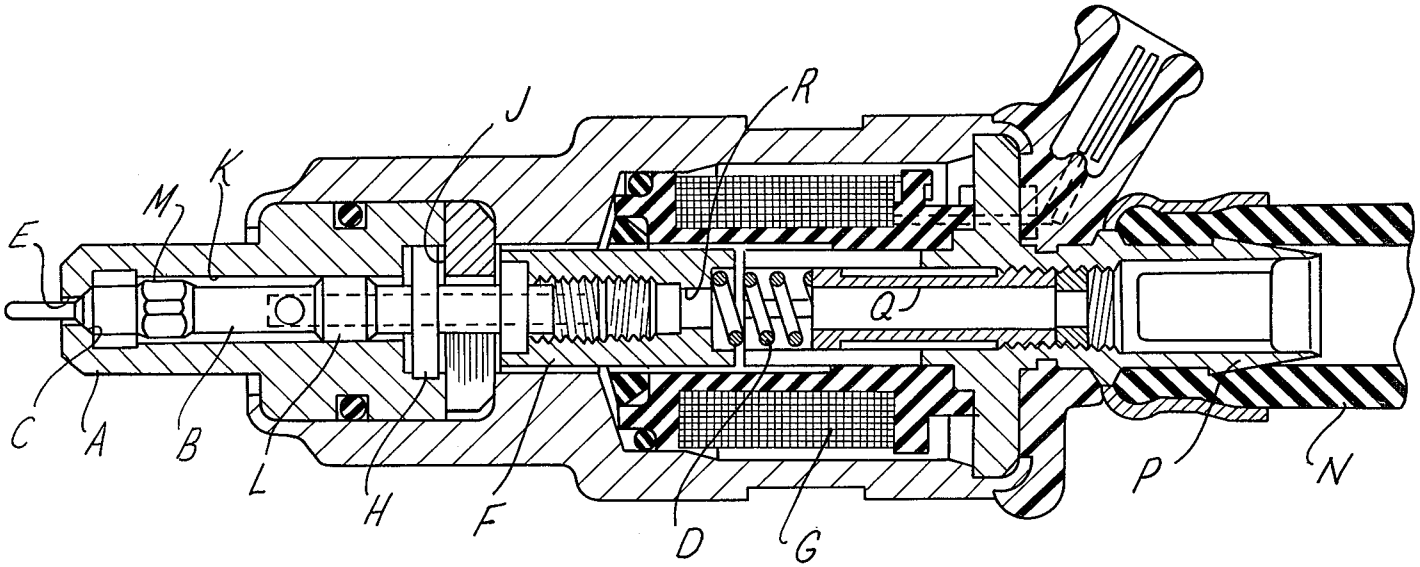
Prior Art FIG. 7

With reference now to the convention fuel injection valve shown in the PRIOR ART FIG. 7, there is shown a pintle-type fuel injection valve comprising a valve body A and a valve needle B that has its tip forced tightly against a valve seat C in the valve body by a compression coil spring D, thereby tightly closing the valve opening E. The needle valve B is provided with an armature F of material which conducts the magnetic flux generated by a magnetic coil G. The delivery of exciting current from a suitable source to the magnetic coil will cause the armature F to move in an axially direction (towards the right in the PRIOR ART FIGURE) until a projection H on the valve needle B abuts against a stop J in the valve body. The valve needle B is centered within a bore K of valve body A by a cylindrical first land L spaced axially upstream on a valve needle B from plurality of axially extending lands M projecting radially outwards from the valve needle B and providing corresponding plurality of axially extending peripherical passages therebetween. When the valve C is opened, fuel under suitable pressure is communicated by a suitable conduit N to a fuel inlet end P of the injector and flows centrally therethrough and through a tubular core element Q to the tubular rear end of valve needle B. The central bore R of valve needle B extends axially inwards from the core end of the valve needle B to a point intermediate lands L and M and there passes radially outwards through a pair of suitable radial apertures S. The flow of fuel proceeds axially therefrom about valve needle B past land M and valve seat C exiting in the annulus defined between valve opening E and needle T, the dimensions of the annulus between the needle T and opening E determining the size, distribution, and cone angle of the droplets comprising the fuel spray.

DETAILED DESCRIPTION OF INVENTION

Turning now to FIGS. 1 and 2, there is shown a fuel injection valve 10 adapted to be positioned by a resilient rubber grommet 12 and a gas back-flow shield cap 14 in a counterbore 16 suitably provided in an intake passage 18 continuously or intermittently communicated with one or more combustion chambers (not shown) of an internal combustion engine 20. Fuel injection valve 10 is further adapted to be communicated with, and biased towards counterbore 16 by a fuel conduit means 22 such as of the type disclosed in the commonly-assigned patent to Wertheimer et al U.S. Pat. No. 3,776,209, entitled "Fuel Injector Manifold and Mounting Arrangement," issued Dec. 4, 1973 on an application having an effective filing date of Sept. 20, 1971, the disclosure of such patent being hereby expressly incorporated herein by reference. At its injector end conduit means 22 comprises a circular groove or counterbore 24 for receiving an elastic and deformable circular seal 26. At its pump end, conduit means 22 is communicated with suitable fuel pump means 28 adapted when energized to pump fuel 30 at a suitable predetermined pressure such as 39 psig from a conventional fuel tank 2 via a suitable fuel line 34.

Fuel injection valve 10 is further adapted to be electrically communicated by means of conductors 36 and 37 and an electrical connector (not shown) with an electronic computing unit (ECU 38) comprising circuits of the type disclosed in commonly-assigned United States patents to Reddy U.S. Pat. Nos. 3,734,068, entitled "Fuel Injection Control System," issued May 22, 1973 on an application having a filing date of Dec. 28, 1970; 2) 3,725,678 to Reddy, issued Apr. 3, 1973 on an application having an effective filing date of Apr. 1, 1971; 3) ,919,981 issued Nov. 18, 1975 on an application filed Jan. 20, 1972, each of such aforementioned patents being hereby expressly incorporated herein by reference. Electronic computing unit 38 is suitably coupled electrically and mechanically with engine 20 to receive information therefrom in the form of engine speed (RPM) signals 40, temperature signals 42, and manifold air pressure signals 44.

Starting at its outlet or left end as viewed with respect to FIG. 2 and working clockwise towards its inlet or right end, fuel injection valve 10 comprises conical spray forming means in the form of an outlet nozzle 50, uniform fuel breakup means in the form of a thin breakup disc 60, metering means and valve seat means in the form of a valve seat and orifice means 70, a tubular actuator housing means 90, tubular valve body means 120, actuator means 140, a molded electrical connector plug assembly 170, and inlet connector means 190, and inlet filter means 220, and a bobbin and terminal assembly means 240.

Nozzle 50

Nozzle 50 comprises a conical surface 52 therethrough diverging from an axial inlet end radial surface 54 to an outlet end radial surface 56, an 18° conical angle of conical surface 52 being selected to tailor the spray envelop of the fuel droplets ejected by injector 10 to be compatible with a particular configuration of inlet passage 18 and/or the combustion chamber intake valves (not shown) of internal combustion engine 20. The circular periphery of nozzle 50 is positioned centrally in an outlet bore 92 of valve body 90 and comprises intermediate inlet end surface 54 and outlet end surface 56 suitable hold-in means in the form of a circular external shoulder 58 for cooperating with suitable valve body hold-in means in the form of a radially inwardly swageable lip 94 to effectively secure nozzle 50, spray disc 60, and valve seat and orifice 70 within housing outlet bore 92 against radial seat 96 counterbored at the inboard end thereof.

Fuel Breakup Disc 60

As may be better understood in conjunction with FIG. 3, fuel breakup disc 60 comprises a thin (0.05 mm) sheet having chemically etched therethrough four-slot groups 61*a–d*, 64*a–d*, 65*a–d*, and 66*a–d* grouped by sectors and positioned radially outboard of a seventh equi-angularly-spaced three-slot group 67*a*, 67*b*, and 67*c*. One arcuate end of each slot in groups 61–66 commences at an arcuate position rotated 5° clockwise when viewed with respect to FIG. 3 from the starting arcuate end of the next radially inboard slot of the same group, and the other end of each slot in a group 61 to 66 terminates to include 6° more than the next radially inboard slot of the same group. In this manner, the arcuately shortest slot in group 61–66 is 30° and the longest, being the fourth slot and therefore having 24 greater degrees of inclusion, is 48°. Each of the three slots 67*a–c* include an angle of 60°.

Each slot has a typical width of 0.05–0.07 mm and has an inner radius spaced from the inner radius of the next adjacent radially outboard slot of 0.18 to 0.25 mm. The 0.20–0.25 mm radial spacing between the outer radial edge of one slot and the inner radial edge of the next radial outboard slot is selected to prevent congealing of sheets of fuel developed by adjacent slots and also to permit efficient chemical etching thereof. The 0.05–0.07 mm radial slot thickness has been found to permit the breakup of fuel into uniformly small droplets of less than 100 microns in diameter with a standard deviation of less than 100 microns and may be satisfactorily developed with conventional etching or possibly stamping processes.

The total number of slots, here 27, their radial widths, and their arcuate lengths are selected so that, for the 0.05 mm typical thickness of the disc 60, and a typical fuel pressure of 39 psig, the total flow area through the slots is more than 150% of the flow area of orifice 76 valve seat and orifice means 70. With such dimensions and fuel pressure, substantially the entire 39 psig is dropped across the metering orifice 76 so that the flow area of the metering orifice determines the magnitude of the flow rate.

As shown in expanded detail in FIG. 4, to provide a suitable clamping surface between nozzle surface 54 and a radial surface 74 at the outlet end of valve seat and metering orifice 70, fuel breakup disc 60 comprises an uninterrupted radial surface 68 radially outboard of the outer most arcuate slots 61*a*, 62*a*, 63*a*, 64*a*, 65*a*, and 66*a*. Moreover, so that unimpeded spray may be developed through these outer slots, the inner diameter of the uninterrupted surface 68 is somewhat less than the inner diameter of either divergent nozzle inlet surface 52 at its inlet side 54 or the outlet diameter of the divergent conical outlet surface 72 of valve seat and orifice 70.

While shown as a structure separate from that of actuator housing 90, nozzle 50 and valve seat and orifice 70 could both be made as a part thereof. A suitable disc receiving groove could then be undercut radially between nozzle 50 and valve seat and orifice 70 to allow thin fuel breakup disc 60 to be snapped into the undercut groove by suitably spring shaping the disc into a conical bevel form while pressing it uniformly and evenly into nozzle 50 from its outlet end 56.

While a presently preferred embodiment of the configuration of fuel breakup disc 60 is shown in FIG. 3, an alternate form thereof is shown in FIG. 3*a* wherein the arcuate lengths of the various radially adjoining arcuate slots are the same as the arcuate lengths described for slots of similar radius with respect to and shown in FIG. 3, the only significant difference being that the slots are all equi-angularly spaced with respect to other slots of the same radius rather than being grouped by sector.

Valve Seat and Orifice 70

As may be better understood in conjunction with the expanded view thereof of FIG. 4, valve seat and orifice 70 is annular about valve axis *x—x* and comprises a smoothly-finished substantially-centrally-located circular orifice 76 having a 0.25 to 0.41 mm axial-length less than its 0.4 mm up to 1.6 mm radial diameter. Orifice 76 communicates a divergent generally conical outlet surface 72 with a convergent generally conical 90° inlet surface 78 terminating at its outer diameter in an annular radial seating surface 80, the outer diameter of conical surface 78 being substantially the same as or merging smoothly with an actuator housing annulus bore 98 in actuator housing 90. Intermediate its inlet and outlet seating surfaces 80 and 74 respectively, valve seat and orifice 70 comprises a pheripheral cylindrical groove 82 containing an O ring 84 suitably compressed against outlet bore 92 of actuator housing 90 to provide a seal thereat. Intermediate inlet seating surface 80 and metering orifice 76 the generally conical converging inlets surface 78 comprises a semi-spherical ball valve seat 86 terminating at its outer cord 87 in a finished circular seating edge 88 loosely concentric with metering orifice 76. Metering orifice 76 is fabricated by first drilling or otherwise roughly forming an initially-under sized aperture through valve seat and orifice 70 and then forcing, or "ballizing," a finished precision ball of final orifice diameter therethrough from the inlet side to the outlet side. Thereafter, semi-spherical ball valve seat 86 and circular valve seat edge 88 are formed in a one step process of forcing or "coining" a finished precision ball 89 of a diameter slightly greater than a ball valve 148 of actuator 140 into the then unheat-treated conical surface 78. Thereafter, valve seat and orifice 70 is mechanically deburred and pacivated and heat treated.

Valve seat and orifice 70 is suitably sized as to metering diameters inlet surfaces, and outlet surfaces etc. for each different engine application and can be made either as a separate element as shown or as an integral part of actuator housing 90, thereby in one step saving at least the cost of an O ring 84 in addition to machining such surfaces as the outer diameter 91 of the valve seat and orifice 70 as well as groove 82 therein and inlet seating edge 80 thereof as well as outlet bore 92 and counterbore seat 96 of actuator housing 90.

Actuator Housing 90

As has already been described with respect to outlet nozzle 50 and valve seat and orifice 70, actuator housing 90 is generally tubular in form about valve axis *x—x* comprising an outlet bore 92 defining an outlet cavity 93 separated by a counterbored seat 96 from an actuator bore 98 defining an actuator cavity 127 and terminated at its axially-outboard outlet end by nozzle hold in means in the form of radially inwardly swageable lip 94. At its axially-opposite outboard inlet end, actuator housing 90 comprises an axially extending lip 100 defined by a counterbored cavity 102 and terminated in a radial abuting surface 104. Upon assembly with valve body 120, radial abuting surface 104 engages a first radial surface 106 of a C washer 108 so as to securely position the other axial side 110 thereof against an annular seat 122 counterbored into an annular hub 124. Hub 124 is located intermediate and actuator annulus or bore 126 bored into one end of the valve body 120 to thereby define an actuator cavity 127 and inlet and coil assembly bore 128 bored into the other end thereof to thereby define a coil and inlet assembly cavity 129.

Intermediate its radially swageable lip 94 and axial lip 100, the periphery of actuator housing 90 comprises a shield cap peripheral surface 112 and a larger diameter valve body peripheral surface 114 separated by an undercut groove 116 and radial shoulder 117. Shield cap surface 112 is selected to provide a snug fit with the internal cylindrical surface 15 of shield cap 14, and valve body peripheral surface 114 is selected to provide a snug fit with actuator housing bore 126 of valve body 120. Radial shoulder 117 comprises hold-in means cooperating with mating hold-in means in the form of a radially inwardly swageable lip 130 of valve body 120 to urge actuator housing 90 and C washer 108 against counter-bored seat 122.

Suitable seal means in the form of an O ring 118 is captured in an O ring groove 119 on the periphery of actuator housing 90 and suitably seals periphery 114 thereof against actuator housing bore 126 of valve body 120.

Valve Body 120

As has already been described with respect to the actuator housing 90, valve body 120 is tubular about valve axis *x—x* and compresses therethrough an actuator housing bore 126 separated by an annular hub 124 from a coil and inlet bore 128. The outboard outlet end of actuator housing bore 126 is terminated by lip 130 that is radially swageable inwardly to engage radial shoulder 117 of annular undercut groove 116 of actuator housing 90. Annular hub 124 comprises an axially extending cylindrical surface 132 that together with an axially extending cylindrical surface 142 of actuator 140 defines a predetermined minimum axial gap 143 of about 0.23 to 0.38 mm. At its inlet end, valve body inlet bore 128 comprises a counterbore 134 axially intermediate an annular raidal seat 136 and a terminating radially inwardly swageable lip 138. When swaged inwardly lip 138 that holds a flange 192 of inlet connector 190 against counterbored seat 136 to position flange 192 both radially and axially with respect to valve body 120.

Actuator 140

Actuator 140 comprises a one piece tubular armature 144, a flexible stem 146, and a ball valve 148, all located either about or along valve axis *x—x*. The tubular armature 144 in turn comprises an armature element 150 separated from a guide element 154 by a radially outwardly extending shoulder element 152. A free end 147 of thin flexible stem 146 is welded to ball valve 148. A fixed end of the stem 146 is centrally positioned in a small bore 149 through the rear quarter of armature element 150 and is suitably affixed axially outboard thereof such as by brazing, welding or staking. Telescoping a substantial length of stem 146 is a central passage 156 opening at its outlet end into actuator bore 98 towards ball valve 148 and terminating at its inboard end at bore 149. The internal diameter of central passage 156 is substantially greater than the external diameter of flexible stem 146 so as to provide a free flowing 1.60 to 1.79 mm total clearance therebetween in which stem 146 may flex freely about its end fixed in bore 149 as ball valve head 148 seats in its slightly oversized ball valve seat 86 in coming to a closed position at circular edge 88 thereof.

Along the periphery 142 of armature element 150 are a pair of diametrically opposed slots 158 cut radially 180° apart from the rear of armature element 150 to a diameter slightly less than that the internal diameter of central passage 156 so as to provide a first free flowing 0.49 × 10.16 mm passage 160 between central passage 156 and each axially extending peripheral slot 158 and a second free flowing 0.49 × 2.47 mm passage 162 through the radial-extending end surface 164 of armature element 150. Armature element passages 160 and 162 thereby freely communicate central passage 156 of actuator 140 with a central outlet bore 194 of inlet connector 190 so as to provide an ample passage for fluid flow therebetween.

The periphery of armature guide element 154 comprises a cylindrical surface 156 of external diameter selected with respect to the internal diameter of actuator bore 98 of actuator housing to effect a loose fit of about 0.007 to 0.035 mm total positive clearance therebetween. The 8.1 mm axially length of guide periphery 166 is selected to be slightly greater than twice the 4 mm diameter thereof. This positive clearance/loose fit between the external periphery 166 of guide element 154 and the internal bore 98 of actuator housing 90 allows pressurized fuel to be forced between and thereby roughly center actuator 140 in both actuator housing bore 98 valve body bore 132 so that, with the actuator 140 in its open position defined when radial surface 153 of shoulder element 152 abuts radial surface 106 of washer 108, the radial air gap 143 between the armature periphery 142 and hub axial surface 132 is not less than about 0.22 mm and the axially air gap 168 between armature end surface 164 and a radial end surface 196 of inlet connector 190 is not less than 0.06 mm.

Molded Plug 170

Molded plug 170 comprises a rectangularly-shaped connector recepticle portion 172 protruding from an annular hub portion 174 at an angle of about 60° with respect to the longitudinal actuation axis *x—x* of fuel injector 10. Hub portion 174 protrudes axially from a flange portion 176 encompassing and sealing the valve body lip 138 as well as inlet connector flange 192 and terminal insulator posts 242 and 244 of coil and bobbin assembly 240. Hub portion 174 and flange portion 176 are capivated axially in groove 198 of inlet connector 190 between a side 286 of inlet connector flange 192 and a shoulder 205 intermediate groove 198 and a shoulder 206. Annular hub 174 comprises a pair of oppositely disposed stake holes 178 and 180 extending radially therethrough to allow the insertion of a staking tool for the purpose of deforming an annular groove portion 198 of inlet connector 190 so as to position a spring adjusting tube 200 in bore 194 thereof. Electrical recepticle portion 172 is terminated at its outboard end by a rectangular peripheral lip 182 bounding a rectangular tapered cavity 184 having a pair of inwardly tapered sides **186*a* and 186*b* defining the long sides of the rectangular cavity 184 and telescoping so as to centrally position therebetween a pair of electrical terminals 246 and 248 protruding through hub portion 174 from terminal insulator posts 242 and 244 respectively. Beveled downward into cavity 184 along a portion of tapered side 186*b* thereof is a inwardly-sloping down surface 187 having a pair of female semi-cylindrical key grooves 188*a* and 188*b* formed therein. The long rectangular sides 186*a* and 186*b* and the short rectangular sides 189*a* and 189*b* of cavity 184** are tapered inwardly to provide a wedging action against an electrical connector (not shown) when inserted therein.

Inlet Connector 190

Inlet connector 190 comprises a radial flange portion 192 intermediate an inlet tube portion 202 and an outlet tube portion 204. Flange surface 286 comprises radially extending knurled identations 193 at the radially outboard edges thereof to lock flange 176 of molded plug 170 and also lip 138 of valve body 120 against relative circumferential motion about valve body axis *x—x*. The periphery of inlet tube portion 202 comprises the deformable circular groove 198 intermediate flange portion 192 and a circular raised shoulder 206. At its inlet end, inlet tube 202 comprises a recessed surface 208 terminated in a radially outward extending shoulder 210 for seating O ring 26. Passing centrally through inlet connector is a stepped-bore comprising an inlet bore 212 and the smaller outlet bore 194. Inlet bore 212 extends into inlet tube portion 202 a length sufficient to amply enclose inlet filter assembly 220, and outlet bore 194 passes through the remainder of inlet tube 202 as well as through flange 192 and outlet tube portion 204. Outlet tube portion 202 terminates in the annular radial surface 196 which forms one side of the axial air gap 168 the other side of which is formed by terminating radial end surface 164 of armature element 150.

Suitably positioned within outlet bore 194 are the spring positioning tube 200 and a helical spring 214. The outer cylindrical periphery of spring positioning tube 200 is knurled or otherwise suitably deformed so as to suitably lock against outlet bore 194 when annular groove 198 is deformed inwardly by staking upon assembly through molded plug apertures 178 and/or 180. When staked, the axial position of tubular spring positioning tube 200 within outlet bore 194 is selected so that, with one end of helical spring 214 positioned against an annular radial terminating shoulder 216 and the other end positioned against the radial end surface 164 of actuator element 150, spring 214 imparts to actuator 140 the proper bias to effect the desired opening and closing dynamics characteristics thereof. Moreover, to more carefully tailor the magnetic circuit provided by coil and bobbin assembly 240 when energized, a pair of thin slots **218*a* and 218*b* (not shown) are cut 180° apart on the periphery 219 at the outlet end of outlet tube portion 204, the axial slots 218 also further enhancing smooth flow of fuel into passages 158 of armature element 150 while also reducing the eddy currents produced in inlet connector 190**.

Inlet Filter Assembly 220

As described above with reference to the inlet connector 90, inlet filter assembly 220 is contained within inlet bore 212 of inlet connector 190. The inlet filter assembly 220 forms a flat-end-shaped axially-extending pocket formed by a pair of screens 222 and 224 of about 325 mesh. The screens 222 and 224 are joined by suitably integrally molding their periphery into a common frame having a pair of webs 227 connecting a flat end 226 with an annular collar forming an inlet opening at the mouth of inlet connector 190. Annular collar 228 is molded over the periphery of screens 222 and 224 and is pressed fitted into inlet bore 212.

Bobbin and Coil Assembly 240

Bobbin and coil assembly 240 comprises a coil 250 of about 306 turns of magnetic wire wound on a spool-like bobbin 252, coil 250 comprising a beginning inner end 254 and a terminating outer end 256 seen better in FIG. 5. Spool 252 comprises an armature end radially extending flange portions 258 and a flange and radially extending flange portion 260, flange portion 258 and 260 being integral with but separated axially by a central axial portion 262 positioned along valve axis *x—x* within valve body cavity 129. The axially outboard sides of flanges 258 and 260 comprise respective annular lips 264 and 266 protruding axially therefrom. Lip 264 comprises an external shoulder 268 cooperating with flange 258 to urge an O ring 270 outwardly against valve body bore 128, and lip 266 comprises an internal shoulder 272 cooperating with flange portion 260 to urge an O ring 274 of the same diameter as O ring 118 inwardly against periphery 219 of outlet tube portion 204.

At its axially outboard end annular lip 266 terminates in an annular radial surface 278 seated against a coil and spool side 280 of connector flange 192, and a small sector of flange 260 and lip 266 thereof comprises the terminal insulating post 242 and 244 as also seen more clearly with respect to FIG. 5. Terminal insulating posts 242 and 244 project axially through a pair of circular apertures 282 and 284 (not shown) provided through connector flange 192 and respectively receive terminals 246 and 248 inserted from the inlet connector side 286 of connector flange 192. The length of each of the terminals 246 and 248 comprises a narrow length portion 288 separated by a neck 290 from a comparatively wider length portion 292, narrow portion 288 having an upwardly protruding conical dimple 294 formed substantially thereacross. Each of the terminals insulating post comprises an arcuately narrow slot 296 passing axially therethrough and of a radial thickness substantially the same as the radial thickness of the narrow portions 288 of terminals 242 and 244. Each of the terminal insulating post 242 and 244 comprises a respective rectangular weld and dimple opening 298 and 300 opening radially outwards from a floor 301 defined by the radially inboard surface of each of the slots 298 and 300 and extending axially inwards from a front wall 302 to a rear wall in the form of flange 260, front wall 302 rising radially above slots 296. The terminals 246 and 248 are assembled into terminal insulating posts 242 and 244 prior to the molding of molded plug 170 by softly forcing the narrow length portion 288 and dimple 294 of each terminal through the terminal slot 206 until a rear surface 304 of each terminal abuts against flange 260 at which point dimple 294 axially clears front wall 302 of each opening 298 and 300 to be adequately restrained from axial movement therein. After the terminals 242 and 244 are thus securely inserted into slots 298 and 300, the beginning and terminating ends 254 and 256 respectively of the coil 250 are positioned in radial slots 306 and 308 through flange 260 and then suitably electrically connected to narrow terminal portion 288 in opening 298 and 300 as by spot welding at a weld point 310 intermediate each dimple 294 and the flange 260. Radial slot 306 further communicates with a down-slot 312 formed on the coil side of flange 260 to provide a suitable wire protection pocket extending radially from the outer cylindrical surface of central portion 262 to the opening floor 301 to provide a suitable pocket therebetween to protect the beginning end 254 of the coil wire 250 from abrasion while winding the remainder of the coil thereof.

MATERIALS

As has been indicated above with respect to actuator 140, armature 144 thereof comprises an armature element 150, a shoulder element 152, and a guide element 154, all of which integral with each other since they are being made from the same piece of bar-stock material. So that the exhibits the proper electromagnetic response to the field created by coil 250 upon energization thereof, armature 144 is made from a ferro magnetic material such as 182 FM provided by the Carpenter Steel Corporation or 18-2 FM provided by Universal Cyclops Uniloy Corporation. Moreover, to afford a uniform coefficient of thermal expansion with armature 144 while at the same time avoiding cell-growing galvanic action with certain dissimilar materials, actuator housing 90 is also made from the same ferro magnetic material. Thin fuel break up disc 60 is made of AISI type L corrosion resistant steel, and the tubular valve body 120 and tubular inlet connector 190 are each made from fully annealed steel AISI 12L14. The molded plug is made from nylon-glass fiber (30%–40%) type 6 nylon reinforced, such material when molded shrinking about the flange 138 of valve body 120 and axial groove 198 to provide a tight seal against one side of connector flange 192. Moreover, the overall outer diameter of fuel injection valve 10 is made materially smaller than that of conventional fuel injection valves of the type shown in the Prior Art Figure and the outer envelope PR of which is shown dotted in about the outer envelope of the fuel injection valve 10 shown in FIG. 2.

SUBSTANTIALLY LAMINAR CENTRAL FUEL FLOW

Fuel injection valve 10 is specifically designed to effect a smooth flow of fuel from the inlet bore 212 thereof to the ball valve head and seat 148 and 86 respectively. When fuel injection valve 10 is connected with fuel rail 22 to receive fuel under a 39 psig pressure and when coil 250 is energized to pull actuator 140 back until shoulder 153 abuts against washer 108, fuel flows into the inlet bore 212 and is there filtered by fuel inlet filter assembly 220. Thereafter, the fuel proceeds centrally through the ample bore of spring adjusting tube 200 and flows axially into end openings 162 of axially slots 158 of armature element 150. Progressing slightly inwardly through passages 160 communicating slots 158 with central guide passage 156, the fuel is substantially straighten and smooth by the remaining length of the guide passage 156, the Reynold's number for the flow between the stem 146 and the actuator annulus 156 being calculated to be in the region of 2900. Emerging from the mouth of the actuator 140, the fluid flows between the stem 146 and the housing annulus 98 with a calculated Reynold's number of a stable laminar 1200 through the opening between the ball valve 148 and the housing annulus 98 where the Reynold's number jumps momentarily to approximately 10,000. However, with the housing annulus 98 merged smoothly with the outer diameter of the conical surface 78 and with an actuating stroke sufficient to provide a 0.08 to 0.15 mm clearance between the ball valve head 148 and the conical surface 78, the flow therebetween drops to a low liminer Reynold's number of 1900.

COMPARATIVE PERFORMANCE RESULTS

The superior performance of the fuel injection valve of the present invention may be better understood as reference to FIGS. *6a, 6b* and *6c* wherein all the solid lines represent the results obtained using an early developmental model of the fuel injection valve of the type shown in FIGS. 2–5 and wherein the dotted lines represent results obtained using a conventional fuel injection valve of the type shown in the Prior Art Figure. As shown in FIG. *6a,* the developmental fuel injection valve of the type disclosed herein provided noticeably better (lower) brake specific fuel consumption BSFC for all air fuel ratios up to 18.5:1 in the case of a 120 ft. lb. dynamometer load at 2,000 engine rpm or 19.5:1 in the case of a 70 ft. lb. load at 1600 rpm. As shown in FIG. *6b,* at an engine load of 70 ft. lb. at an speed of 1600 rpm the fuel injection valve of the present invention produces slightly lower carbon monoxide (CO) emissions up to an air fuel ratio of 15:1, substantially lower hydrocarbon (HC) emissions out to an air fuel ratio of 18:1 lower nitrogen oxide ($NO_x$) emission are generated above air fuel ratios of about 15.5:1, and the improvement becomes more pronounced and uniform at higher loads and speeds where shown in FIG. *6c* the fuel injection valve 10 of the present invention produces uniformly and substantially lower nitrogen oxide ($NO_x$) emissions for all air fuel ratios, substantially lower hydro-carbon (HC) emissions, and slightly low carbon monoxide (CO) emissions.

RECAPITULATION

As fully explained above, the fuel injection valve 10 of the present invention is adapted to be suitably mounted on an internal combustion engine 20 so as to be communicated with an intake passage 18 thereof and comprises a tubular valve body 120 having a central stepped bore 126 and 128 therethrough along a longitudinal valve body axis *x—x*. The valve body 120 comprises annular hub means 124, C washer stop means 108, and axially separated first and secondhold means in the form of inwardly swageable lips 130 and 138. The hub means 124 separate the stepped bore 126 and 128 into a coil and inlet means cavity 129 and comprises the stop means positioning surface 122 and a first circumferential flux path surface 132 defining one side of a two sided radial air gap 143. The C washer stop means 108 are positioned axially against the stop means positioning surface 122 of the hub means 124 and extend radially inwards therefrom so as to be abutable against radial surface 153 of actuator shoulder element 152. The inlet connector means 190 are secured in the coil and inlet means cavity 129 by means of the inwardly swageable lip 138 acting axially so as to seat flange 192 against a seat 136 counterbored in the tubular body 120. The tubular inlet connector 190 comprises an outwardly extending flange portion 192 intermediate an inlet tube portion 202 and an outlet tube portion 204. The inlet tube portion 202 is adapted to be connected as by fuel rail means 22 with a source of pressurized fuel and together with the outlet tube portion 204 has a central fuel passage 194–212 therethrough along the valve body axis *x—x*. The outlet tube portion 204 further comprises an annular terminating surface 196 defining one side of a two sided axially air gap 168.

Fuel injection valve 10 further comprises actuator housing means 90 secured in the actuator housing cavity formed by bore 126 of tubular valve body 120 and is held therein by the other of the valve body hold in means comprising inwardly swageable lip 130. The actuator housing means 90 has a central stepped-bore extending therethrough along the valve body axis *x—x*, this stepped bore being separated by the valve seat and orifice means seat 96 into a fuel outlet bore portion 92 and an actuator bore portion 98. The fuel outlet bore portion 92 is terminated in fuel outlet hold-in means in the form of the inwardly swageable lip 94, and the actuator bore portion 98 has shoulder abutment means in the form of lip 104 of counterbore 102 abuting against the valve body stop means in the form of C washer 108. The valve seat and metering orifice means 70 has an inlet side 80 and an outlet side 74 and comprises intermediate therebetween a centrally-located metering orifice 76 the outlet end of which is contiguous with an outlet surface 72 diverging towards the outlet side 74 and the inlet end of which is contiguous with two contiguous inlet surfaces 78 and 86. Inlet surface 78 is conical and inlet surface 86 is partly spherical to define at their intersection the circular valve seat edge 88. Secured in the fuel outlet bore portion 92 against the outlet side 74 of the valve seat and metering orifice 70 are fuel outlet means in the form of the guide nozzle 50 and the thin fuel breakup disc 60. The fuel breakup disc 60 comprises a plurality of thin arcuate slots etched therethrough, each slot having a radial width of optimally not greater than 0.1 mm and an arcuate length not less than twice this radial width. The number and lengths of the arcuate slots are selected to effect a total slot area which is at least 150% of the area of the metering orifice 76.

The actuator means 140 comprises the armature means 144, and ball valve head 148, and the stem 146 and is loosely supported with a 0.007 to 0.035 mm total clearance relative to the actuator bore portion 98 of actuator housing means 90 and are adapted to reciprocate axially therein along the valve body axis *x—x* between an open position and a closed position. The armature means 144 comprises a one piece guide element 154, abutment element 152, and armature element 150. The abutment element 152 is adapted to abut against the valve body C washer stop means 108 to there establish the open position of the armature. The armature element 150 comprises a second circumferential flux path surface 142 and a second transverse flux path surface 164 cooperating with the first circumferentially flux surface 132 of hub 124 and the first transverse flux path surface 196 of the outlet tube portion 184 to respectively define the other sides of the radial air gap 143 and the axial air gap 168. The guide element 154 of the armature means 144 has an arcuate peripheral surface 166 loosely engaging the actuator bore portion 98 so as to sufficiently center the actuator means to prevent the width of the first and second air gap 143 and 166 from being less than first and second predetermined air gaps. The guide element 154 and the armature element 150 of the armature means 144 also have a flow smoothing fuel passage means 156, 160, 158 and 162 therethrough communicating with the central inlet passage 194 means 218 and 212 of the inlet connector 190.

The valve head and stem means 148 and 146 have a free end terminated in the partly spherical valve head 148, a fixed end terminated centrally in at bore 149 of armature element 150, and a stem length intermediate this free end and fixed end telescoped by the portion 156 of the central flow smoothing passage means. The stem 146 has a radial clearance in bore 156 as the partly spherical valve head 148 is guided by the partly spherical valve surface 186 to seat on the circular valve seat edge 88 and there establish the closed position of the actuator means 140.

Spring means in the form of the helical spring 214 are positioned between the fixed radial end 216 of the outlet tube portion 204 of the inlet connector 190 and the reciprocable terminating radial end 264 of armature element 150 to normally biased the actuator means 140 in a direction from the tubular inlet means 190 toward the valve seat and orifice means 70.

Electromagnetic coil means 250 are positioned in the coil and inlet means cavity 129. Intermediate the valve body hub means 124 and the inlet flange portion 192 and are operative when energized to establish a magneto motive force on the armature element 144 sufficient to overcome the closing bias of spring 214 to move the actuator means 140 from its closed position to its open position.

CONCLUSION

Having described several embodiments of the invention, it is understood that the specific terms and examples are employed herein in a descriptive sense only and not for the purpose of limitation. Other embodiments of the invention, modification thereof, and alternatives thereof will be obvious to those skilled in the art and may be made without departing from our invention. We therefore aim in the apended claims to cover the modifications and changes as we would in the true scope and spirit of our invention.

What we claim is:

1. In a fuel injection valve adapted to be mounted on an internal combustion engine so to be communicated with an intake passage of a combustion chamber thereof comprising:

fuel outlet means adapted to be communicated with said intake passage and comprising a fuel metering member and a fuel breakup member;

said fuel metering member comprising a converging inlet surface, a diverging outlet surface, and a metering orifice intermediate said inlet surface and said outlet surface, said metering orifice having a total orifice flow area thereacross for effecting a predetermined flow rate of fuel therethrough; and said fuel breakup member comprising a thin disk having an axial thickness not substantially greater than 0.05 mm secured across said diverging outlet surface and comprising a plurality of narrow slots therethrough for breaking said fuel up into uniformly small droplets, said slots having a total slot area thereacross establishing a minimum orifice-to-slot area ratio with said total orifice area of not less than 1.5, said orifice-to-slot area ratio and said 0.05 mm axial thickness of said thin disk cooperating to permit said orifice area to determine substantially the entire magnitude of said predetermined flow rate.

2. The fuel outlet means of claim 1 wherein at least one of said slots is arcuate and is positioned circumferentially so as to comprise a radial width of less than 0.10 mm and an arcuate length of greater than 15°, said radial width and arcuate length being selected to develop a thin sheet of fuel that breaks up into said uniformly small droplets.

3. The fuel outlet means of claim 2 wherein said slots comprise at least three said arcuate slots radially spaced to develop a separate sheet of fuel and each said arcuate slot comprises an arcuate length of at least 5° longer than that of its adjoining radially inboard slot.

* * * * *